United States Patent [19]

Palma

[11] Patent Number: 4,687,202

[45] Date of Patent: Aug. 18, 1987

[54] COMBINATION PUZZLE, BOX AND HANGABLE PUZZLE FRAME

[76] Inventor: Beverly Palma, 6942 NW. Prairie View Rd., Kansas City, Mo. 64151

[21] Appl. No.: 869,096

[22] Filed: May 30, 1986

[51] Int. Cl.[4] ..... A63F 9/10

[52] U.S. Cl. ..... 273/157 R; 40/152.1

[58] Field of Search ..... 273/157 R; 40/152, 152.1, 40/156

[56] References Cited

U.S. PATENT DOCUMENTS

| | | | |
|---|---|---|---|
| 1,692,999 | 11/1928 | Siegel | 40/156 |
| 1,702,505 | 2/1929 | Groves | 273/157 R |
| 1,789,782 | 1/1931 | Shockley | 273/157 R |
| 1,913,850 | 6/1933 | Oberdorfer | 273/157 R |
| 2,412,180 | 12/1946 | Slocum | 273/157 R |
| 2,427,318 | 9/1947 | Warren | 273/157 R |
| 3,002,309 | 10/1961 | Snyder | 273/157 R X |
| 3,606,338 | 9/1971 | Cannata | 273/157 R |
| 3,988,846 | 11/1976 | Kuhling | 40/152.1 |
| 4,142,726 | 3/1979 | Anderson | 273/157 R |
| 4,302,013 | 11/1981 | Kauis | 273/157 R |
| 4,486,018 | 12/1984 | Keller, Jr. | 273/157 R |

FOREIGN PATENT DOCUMENTS

| | | | |
|---|---|---|---|
| 434491 | 8/1935 | United Kingdom | 273/157 R |

*Primary Examiner*—Anton O. Oechsle

*Attorney, Agent, or Firm*—Litman McMahon & Brown

[57] ABSTRACT

A combination puzzle, box and hangable puzzle frame comprises a base, including a bottom wall and continuous sidewall defining an upwardly opening recess. The base is adapted to receive therein a cover, including a transparent top wall and continuous sidewall defining a downwardly opening recess. The corresponding sidewalls are adapted for interlocking engagement. When the cover is received within the base, with the bottom wall and top wall in spaced apart relation, a storage enclosure is formed. The storage enclosure may be used to store the randomly mixed pieces of an uncompleted puzzle. The cover is freely separable from the base, and may be inverted and inserted within the upwardly opening recess. When the cover is so inverted and inserted, the bottom wall and top wall are in close proximity, to form a picture frame type display enclosure when viewed from the transparent top wall. A completed puzzle placed within the display enclosure is held rigidly in place by respective engagement therewith of the bottom wall and top wall. The bottom wall contains an opening to receive a nail for supporting the combination on a wall in the nature of a conventional picture frame.

3 Claims, 5 Drawing Figures

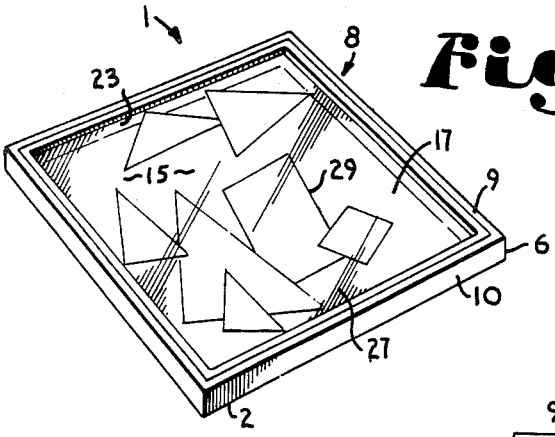
Fig. 1.
Fig. 2.
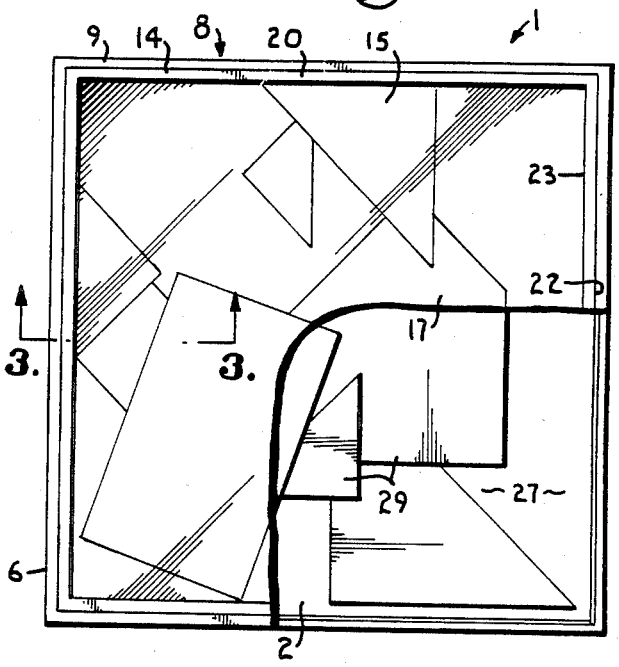
Fig. 3.
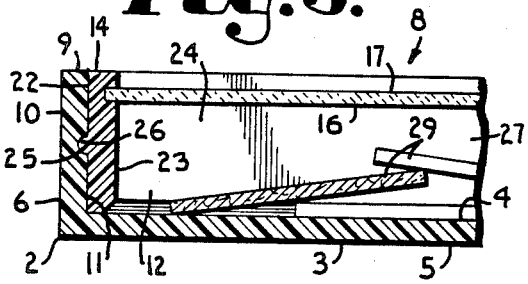
Fig. 4.
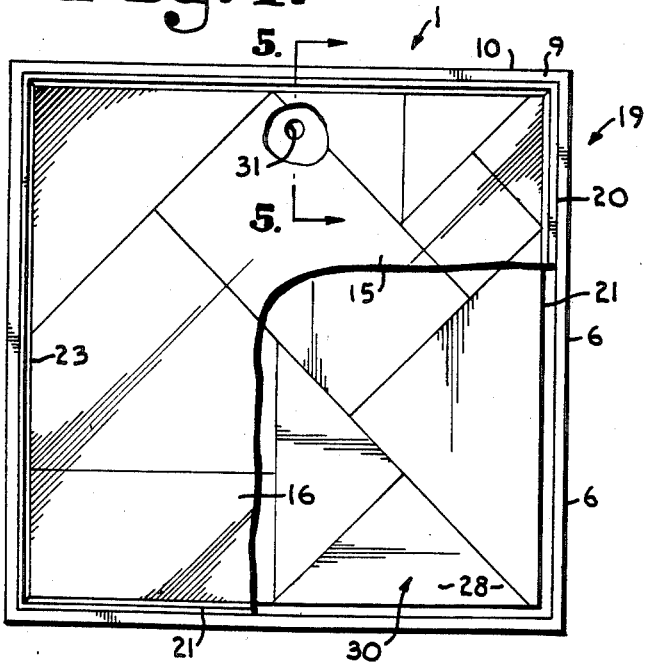
Fig. 5.
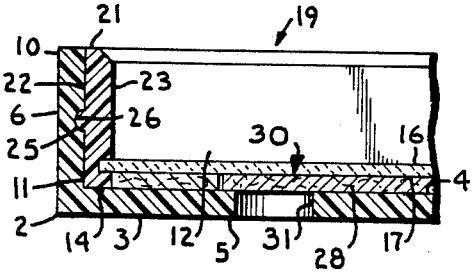

COMBINATION PUZZLE, BOX AND HANGABLE PUZZLE FRAME

FIELD OF THE INVENTION

The present invention relates to puzzles and puzzle containers, and in particular to a combination puzzle, box and hangable puzzle frame having a box with a bottom portion including a bottom wall and sidewall and a top portion including a transparent top wall and sidewall. The top portion fits within the bottom portion to form a storage enclosure for loose puzzle pieces, wherein the top wall and bottom wall are spaced apart. Corresponding sidewalls are adapted for interfitting engagement. The top portion may also be inverted and inserted within the bottom portion, whereby the top wall and bottom wall are in close proximity to form a display enclosure, wherein a completed puzzle is rigidly held in place. The bottom wall is perforated to allow for hanging.

BACKGROUND OF THE INVENTION

The picture puzzle is a well-known social diversion. It serves a variety of purposes, for example as a method of teaching children manual dexterity, and as a means for adults to pass idle time. Puzzles, however, have long been enjoyed as a process rather than a product. That is, one may enjoy the task of working a puzzle, and this enjoyment may last a relatively long time, depending upon the difficulty of the puzzle. On the other hand, enjoyment of the completed puzzle is usually quite limited, since the puzzle must be left where completed, as any movement will likely lead to disassembly.

Various approaches have been taken toward making the completed puzzle more permanent. In one design, a transparent base and cover are hinged to close about a puzzle whose pieces are outsized and compressable. The resulting tension holds the puzzle firmly in place. One solution to the problem has been to attach adhesive material to the back of the puzzle before inserting it in a frame. A complicated, interlocking storage tray, assembly tray and display tray is available, in which posts distributed about the edge of the puzzle prevent it from moving when assembled for display.

Existing designs do not adequately address the problems associated with the inherent instability of completed puzzles. A design which requires outsized puzzle pieces necessarily limits the number of available puzzles. Adhesive material applied to a puzzle backing renders the puzzle unusable for anything but display. The use of a complicated storage/assembly/display device is cumbersome, and its use of retaining posts does not permit hanging display.

OBJECTS OF THE INVENTION

Therefore, the principal objectives of the present invention are: to provide a combination puzzle, box and hangable puzzle frame that is convenient and pleasant to use; to provide such a combination in which a puzzle includes multiple interlocking pieces; to provide such a combination in which a box has a bottom portion including a bottom wall and sidewall defining an upwardly opening recess; to provide such a combination wherein the box includes a top portion with a transparent top wall and sidewall defining a downwardly opening recess; to provide such a combination in which the top and bottom sidewalls are adapted for interfitting engagement to form a storage enclosure, wherein the top and bottom walls are spaced apart with said puzzle pieces therebetween; to provide such a combination wherein the top portion may be inverted for insertion within the upwardly opening recess so that the bottom wall and top wall are in close proximity to form a display enclosure for a puzzle; and to provide such a combination which is relatively inexpensive, easy to use and well adapted for the intended purpose.

Other objects and advantages of this invention will become apparent from the following description taken in conjunction with the accompanying drawings wherein are set forth, by way of illustration and example, certain embodiments of the invention.

The drawings constitute a part of this specification and include exemplary embodiments of the present invention and illustrate various objects and features thereof.

BRIEF DESCRIPTION OF THE DRAWINGS

FIG. 1 is a perspective view of a combination puzzle, box and hangable puzzle frame, according to the present invention.

FIG. 2 is a plan view of the combination shown in FIG. 1, with a portion thereof cut away to expose internal detail.

FIG. 3 is a fragmented sectional view taken along lines 3—3, FIG. 2; the combination is shown in storage configuration with puzzle unassembled.

FIG. 4 is a plan view of the combination shown in FIG. 1; the combination is in a display configuration, with the puzzle assembled; a portion is cut away to show detail.

FIG. 5 is a fragmented sectional view taken along lines 5—5, FIG. 4; the combination is in a display configuration, with the puzzle assembled.

DETAILED DESCRIPTION OF THE INVENTION

As required, a detailed embodiment of the present invention is disclosed herein, however, it is to be understood that the disclosed embodiment is merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates the combination puzzle, box and hangable puzzle frame of the present invention. The illustrated combination 1 has a bottom portion 2. The bottom portion 2 includes a bottom wall 3, having an inner face 4 and an outer face 5. Sidewall 6 is integral with the bottom wall 2, and extends about its circumference. The sidewall 6 has an edge 9, an outer surface 10 and an inner surface 11. The bottom wall 2 and sidewall 6 define an upwardly opening recess 12.

In the illustrated example, the combination 1 includes a top portion 14. The top portion 14 has a transparent top wall 15, with an inner face 16 and an outer face 17. A sidewall 20 is integral to the top wall 15, and has an edge 21 and an outer surface 22 and an inner surface 23. A downwardly opening recess 24 is defined by the top wall 15 and the sidewall 20.

In a first configuration 8, the bottom portion 2 is adapted to receive the top portion 14 within the upwardly opening recess 12. In the illustrated example, outer surface 22 includes a projection 25. Projection 25 interfits a recess 26 located in inner surface 11 of sidewall 6. The edge 21 of the sidewall 20 contacts the inner face 4 of the bottom wall 3. Inner surface 11 of sidewall 6 engages outer surface 22 of sidewall 20. Bottom wall 3 is then distal from top wall 15, defining a storage enclosure 27. The storage enclosure 27 can accommodate an unassembled puzzle 29.

The top portion 14 is freely separable relative to the bottom portion 2. In a second configuration 19, the top portion 14 is inverted and inserted within the upwardly opening recess 12. In the illustrated example, inner surface 11 of sidewall 6 engages outer surface 22 of sidewall 20, and projection 25 interfits recess 26 as in the first configuration 8. In the second configuration 19, outer face 17 of top wall 15 is in close proximity to inner face 4 of bottom wall 3, thereby defining a display enclosure 28 for a completed puzzle 30. The completed puzzle 30 is engaged and secured by top wall 15 and bottom wall 3 when placed within diplay enclosure 28, and is viewable through transparent top wall 15.

The first configuration 8 may be used for both presale packaging and postsale storage of the puzzle. In this configuration, the top portion 14 serves as the top of the box or package. For purposes of presale packaging, the puzzle may be displayed in either its assembled or unassembled state. In the alternative, the box or package may be covered with wrapping which, for example, may show the puzzle in its completed form.

Second configuration 19 is intended to be used for display of the completed puzzle. In this configuration, top wall 15 acts as the transparent cover for the puzzle, which is held rigidly in place in the display enclosure 28 by being placed between contacting top wall 15 and bottom wall 3. An aperture 31 is located on the bottom portion 2 to facilitate hanging of the puzzle display.

It is to be understood that while certain forms of the present invention have been illustrated and described herein, it is not to be limited to the specific forms or arrangement of parts described and shown.

I claim:

1. In combination, a puzzle and box therefore.

(a) said puzzle comprising multiple interlocking pieces;

(b) said box including a bottom portion comprising a bottom wall and a sidewall defining an upwardly opening recess;

(c) said box further including a top portion comprising a transparent top wall and sidewall defining a downwardly opening recess;

(d) said bottom portion sidewall and said top portion sidewall including interengaging members adapted for interfitting engagement to form a storage enclosure wherein said bottom wall and said top wall are in spaced apart relation with said puzzle pieces therebetween;

(e) said interengaging members adapted to secure said top and bottom walls in close proximity to each other when said top portion is inverted and inserted into said upwardly opening recess, (f) whereby said top and bottom walls are adapted to engage and secure said puzzle therebetween after puzzle completion and display the completed puzzle through said transparent top wall.

2. The combination as set forth in claim 1 wherein:

(a) said bottom wall contains a nail receiving opening for hanging said combination on a wall with a nail.

3. The combination as set forth in claim 1 wherein:

(a) said interengaging members comprise a circular groove and a circular projection which interfit.

* * * * *